US007450020B2

(12) United States Patent
McSheffrey et al.

(10) Patent No.: US 7,450,020 B2
(45) Date of Patent: Nov. 11, 2008

(54) SIGNALING PRESSURE DETECTION ASSEMBLY

(75) Inventors: Brendan T. McSheffrey, Newton, MA (US); John J. McSheffrey, Sr., Hingham, MA (US)

(73) Assignee: MIJA Industries, Inc., Rockland, MA (US)

( * ) Notice: Subject to any disclaimer, the term of this patent is extended or adjusted under 35 U.S.C. 154(b) by 488 days.

(21) Appl. No.: 11/123,899

(22) Filed: May 6, 2005

(65) Prior Publication Data

US 2005/0237210 A1 Oct. 27, 2005

Related U.S. Application Data

(63) Continuation-in-part of application No. 10/274,606, filed on Oct. 21, 2002, which is a continuation-in-part of application No. 09/832,531, filed on Apr. 11, 2001, now Pat. No. 6,585,055, which is a continuation-in-part of application No. 09/212,121, filed on Dec. 15, 1998, now Pat. No. 6,302,218, which is a continuation of application No. 08/879,445, filed on Jun. 20, 1997, now Pat. No. 5,848,651, and a continuation-in-part of application No. PCT/US97/01025, filed on Jan. 23, 1997, now abandoned, which is a continuation-in-part of application No. 08/590,411, filed on Jan. 23, 1996, now Pat. No. 5,775,430.

(51) Int. Cl.
*G08B 21/00* (2006.01)

(52) U.S. Cl. ..... 340/614; 169/75; 169/23

(58) Field of Classification Search ..... 340/614, 340/539.1, 539.11; 169/75, 23, 57, 60, 30
See application file for complete search history.

(56) References Cited

U.S. PATENT DOCUMENTS

| | | | |
|---|---|---|---|
| 922,456 | A | 5/1909 | Casey |
| 2,670,194 | A | 2/1954 | Hansson |
| 3,145,375 | A | 8/1964 | Webb |
| 3,333,641 | A | 8/1967 | Hansom |
| 3,664,430 | A | 5/1972 | Sitabklhan |
| 3,735,376 | A | 5/1973 | Kermer |
| 3,946,175 | A | 3/1976 | Sitabkhan |

(Continued)

FOREIGN PATENT DOCUMENTS

| | | |
|---|---|---|
| DE | 3 731 793 | 3/1989 |

(Continued)

OTHER PUBLICATIONS

NFPA 10 Standard for Portable Fire Extinguishers, 1998 Edition; Nat'l Fire Protection Assoc., pp. 10, Feb. 6, 1998.

(Continued)

*Primary Examiner*—John Tweel, Jr.
(74) *Attorney, Agent, or Firm*—Fish & Richardson P.C.

(57) ABSTRACT

Apparatus for remote monitoring of a portable pressurized container, such as the tank of a fire extinguisher, includes a pressure sensor that detects pressure of material contained within a volume defined by the portable container and communications circuitry in communication with the pressure sensor that issues a signal containing information about the pressure detected by the pressure sensor to a remote central station.

21 Claims, 8 Drawing Sheets

U.S. PATENT DOCUMENTS

| | | | | |
|---|---|---|---|---|
| 4,003,048 | A | 1/1977 | Weise | |
| 4,015,250 | A | 3/1977 | Fudge | |
| 4,034,697 | A | 7/1977 | Russell | |
| 4,051,467 | A | 9/1977 | Galvin | |
| 4,100,537 | A | 7/1978 | Carlson | |
| 4,101,887 | A | 7/1978 | Osborne | |
| 4,125,084 | A | 11/1978 | Salmonsen | |
| 4,143,545 | A | 3/1979 | Sitabkhan | |
| 4,184,377 | A | 1/1980 | Hubbard | |
| 4,279,155 | A | 7/1981 | Balkanli | |
| 4,289,207 | A | 9/1981 | Wernert | |
| 4,303,395 | A | 12/1981 | Bower | |
| 4,342,988 | A | 8/1982 | Thompson et al. | |
| 4,360,802 | A | 11/1982 | Pinto | |
| 4,418,336 | A | 11/1983 | Taylor | |
| 4,419,658 | A | 12/1983 | Jarosz | |
| 4,531,114 | A | 7/1985 | Topol | |
| 4,548,274 | A | 10/1985 | Simpson | |
| 4,586,383 | A | 5/1986 | Blomquist | |
| 4,599,902 | A | 7/1986 | Gray | |
| 4,613,851 | A | 9/1986 | Hines | |
| 4,697,643 | A | 10/1987 | Sassier | |
| 4,805,448 | A | 2/1989 | Armell | |
| 4,823,116 | A | 4/1989 | Kitchen, III et al. | |
| 4,835,522 | A | 5/1989 | Andrejasich et al. | |
| 4,866,423 | A | 9/1989 | Anderson | |
| 4,887,291 | A | 12/1989 | Stillwell | |
| 4,890,677 | A | 1/1990 | Scofield | |
| 4,928,255 | A | 5/1990 | Brennecke et al. | |
| 4,979,572 | A | 12/1990 | Mikulec | |
| 5,153,567 | A | 10/1992 | Chimento | |
| 5,224,051 | A | 6/1993 | Johnson | |
| 5,357,242 | A | 10/1994 | Morgano | |
| 5,460,228 | A | 10/1995 | Butler | |
| 5,475,614 | A | 12/1995 | Tofte et al. | |
| 5,483,826 | A * | 1/1996 | Schultz et al. | 73/146.5 |
| 5,486,811 | A | 1/1996 | Wherle | |
| 5,534,851 | A | 7/1996 | Russek | |
| 5,578,993 | A | 11/1996 | Sitabkhan et al. | |
| 5,596,501 | A | 1/1997 | Comer et al. | |
| 5,613,778 | A | 3/1997 | Lawson | |
| 5,652,393 | A | 7/1997 | Lawson | |
| 5,706,273 | A | 1/1998 | Guerreri | |
| 5,728,933 | A * | 3/1998 | Schultz et al. | 73/146.5 |
| 5,775,430 | A | 7/1998 | McSheffrey | |
| 5,781,108 | A | 7/1998 | Jacob | |
| 5,793,280 | A | 8/1998 | Hincher | |
| 5,848,651 | A | 12/1998 | McSheffrey | |
| 5,853,244 | A | 12/1998 | Hoff et al. | |
| 5,864,287 | A | 1/1999 | Evans | |
| 5,877,426 | A | 3/1999 | Hay | |
| 5,936,531 | A | 8/1999 | Powers | |
| 5,952,919 | A | 9/1999 | Merrill | |
| 6,014,307 | A | 1/2000 | Crimmins | |
| 6,114,823 | A | 9/2000 | Doner | |
| 6,125,940 | A | 10/2000 | Oram | |
| 6,155,160 | A | 12/2000 | Hochbrueckner | |
| 6,168,563 | B1 | 1/2001 | Brown | |
| 6,240,365 | B1 | 5/2001 | Bunn | |
| 6,270,455 | B1 | 8/2001 | Brown | |
| 6,279,664 | B1 * | 8/2001 | Yanovsky et al. | 169/75 |
| 6,289,331 | B1 | 9/2001 | Pedersen et al. | |
| 6,302,218 | B1 | 10/2001 | McSheffrey et al. | |
| 6,311,779 | B2 | 11/2001 | McSheffrey | |
| 6,317,042 | B1 | 11/2001 | Engelhorn et al. | |
| 6,336,362 | B1 | 1/2002 | Duenas | |
| 6,351,689 | B1 | 2/2002 | Carr et al. | |
| 6,357,292 | B1 | 3/2002 | Schultz et al. | |
| 6,401,713 | B1 | 6/2002 | Hill et al. | |
| 6,450,254 | B1 | 9/2002 | Hoyle et al. | |
| 6,488,099 | B2 | 12/2002 | McSheffrey et al. | |
| 6,496,110 | B2 | 12/2002 | Peterson et al. | |
| 6,542,076 | B1 | 4/2003 | Joao | |
| 6,585,055 | B2 | 7/2003 | McSheffrey et al. | |
| 6,587,049 | B1 | 7/2003 | Thacker | |
| 6,598,454 | B2 | 7/2003 | Brazier et al. | |
| 6,646,545 | B2 | 11/2003 | Bligh | |
| 6,856,251 | B1 | 2/2005 | Tietsworth et al. | |
| 7,081,815 | B2 * | 7/2006 | Runyon et al. | 340/539.1 |
| 2003/0071736 | A1 | 4/2003 | Brazier et al. | |
| 2003/0116329 | A1 | 6/2003 | McSheffrey | |
| 2003/0135324 | A1 | 7/2003 | Navab | |

FOREIGN PATENT DOCUMENTS

| | | |
|---|---|---|
| FR | 2 340 109 | 9/1977 |
| FR | 2 515 845 | 5/1983 |
| FR | 2 676 931 | 12/1992 |
| WO | WO 81/02484 | 9/1981 |
| WO | WO 94/11853 | 5/1994 |
| WO | WO 01/46780 | 6/2001 |
| WO | WO 01/93220 | 12/2001 |
| WO | WO 03/076765 | 9/2003 |
| WO | WO 03/098908 | 11/2003 |

OTHER PUBLICATIONS

Cole-Parmer Brochure, "Exciting New Products for Measuring Flow and Pressure," Canada, received Apr. 23, 1996, 1 page.

Press Release, "Help That comes Too Late Is As Good As No Help At All—The Fire Extinguisher Alarm System Gives Immediate Help", Undated, Invention Technologies, Inc., Jul. 21, 2005.

* cited by examiner

SIGNALING PRESSURE DETECTION ASSEMBLY

CROSS REFERENCE TO RELATED APPLICATIONS

This application is a continuation-in-part of U.S. application Ser. No. 10/274,606, filed Oct. 21, 2002, now pending, which is a continuation-in-part of U.S. application Ser. No. 09/832,531, filed Apr. 11, 2001, now U.S. Pat. No. 6,585,055, issued Jul. 1, 2003, which is a continuation-in-part of U.S. application Ser. No. 09/212,121, filed Dec. 15, 1998, now U.S. Pat. No. 6,302,218, issued Oct. 16, 2001, which is a continuation of U.S. application Ser. No. 08/879,445, filed Jun. 20, 1997, now U.S. Pat. No. 5,848,651, issued Dec. 15, 1998, which is a continuation-in-part of U.S. application Ser. No. 08/590,411, filed Jan. 23, 1996, now U.S. Pat. No. 5,775,430, issued Jul. 7, 1998, and a continuation-in-part of International Application No. PCT/US97/01025, with an International Filing Date of Jan. 23, 1997, now abandoned, the complete disclosures of all of which are incorporated herein by reference.

BACKGROUND

This disclosure relates to fire extinguishers, e.g., of the type for domestic, office, or industrial use, and other pressurized fluid containers.

Fire extinguishers are provided for use in all manner of environments, typically situated in standby condition in an unobtrusive location selected for reasonably easy access in a fire emergency.

SUMMARY

In one aspect, the invention features an apparatus for remote monitoring of a fire extinguisher (e.g., a portable fire extinguisher or a portable, hand-held extinguisher) that includes a pressure sensor configured to detect pressure of fire extinguishing material contained within a volume defined by a fire extinguisher tank and communications circuitry in communication with the pressure sensor and configured to issue a signal (e.g., a wireless signal) containing information about the pressure detected by the pressure sensor to a remote central station.

Embodiments may include one or more of the following features. The communications circuitry may be configured to issue a signal upon detection by the pressure sensor of a predetermined pressure condition (e.g., a predetermined pressure reading). The communications circuitry may also be configured to periodically issue a signal containing information about the pressure detected by the pressure sensor to the remote central station. The communication circuitry may also be configured to receive signals from the remote central station, and may include in signals sent to the central station unique identification information that identifies the fire extinguisher from others.

The pressure sensor may include a gauge (e.g., a Bourdon coiled tube gauge) mounted to the fire extinguisher and disposed in communication with the volume for detection and display of a pressure condition of the fire extinguishing material contained within the volume of the fire extinguisher tank. The gauge may include a gauge scale suitable and a pointer moveable relative to the scale for a visible indication of pressure. The gauge may also include an electrical switch that is tripped when the gauge pointer moves to a predetermined location relative to the gauge scale indicating the pressure condition is at a predetermined pressure reading.

The apparatus may include a docking station. The docking station may house some of the communications circuitry.

In implementations for use with a portable fire extinguisher, the apparatus may further include a second sensor, such as a tether, that detects removal of the portable fire extinguisher from its predetermined location (e.g., an installed location). The electronic circuit may also be configured to issue a signal to the remote central station upon detection of removal of the portable fire extinguisher from its predetermined location.

The apparatus may also include an electroluminescent light panel that illuminates a portion of the fire extinguisher in a low light condition. It may also include a light sensor for detecting such a low light condition. The apparatus may include an audio signaling device that emits an audible signal when an out-of-range pressure condition detected. It may also include a timer configured to trigger an alert when an inspection is due for the fire extinguisher. If the communications circuitry is powered by a battery, the apparatus may also include a battery monitor for detecting and alerting a low battery condition.

In another aspect, the invention features an apparatus for remote monitoring of a portable pressurized container, such as a fire extinguisher tank, that includes a pressure sensor configured to detect pressure of material contained within a volume defined by the portable container and communications circuitry in communication with the pressure sensor for issue of a wireless signal containing information about the pressure detected by the pressure sensor to a remote central station.

Embodiments may include one or more of the following features. The portable container is a fire extinguisher tank that is configured to be attached to a hand-held valve assembly. The communications circuitry may configured to issue a signal upon detection by the pressure sensor of a predetermined pressure condition (e.g., a predetermined pressure reading).

These and other features and advantages will be apparent from the following description of a presently preferred embodiment, and from the claims.

DETAILED DESCRIPTION

Figure 1:
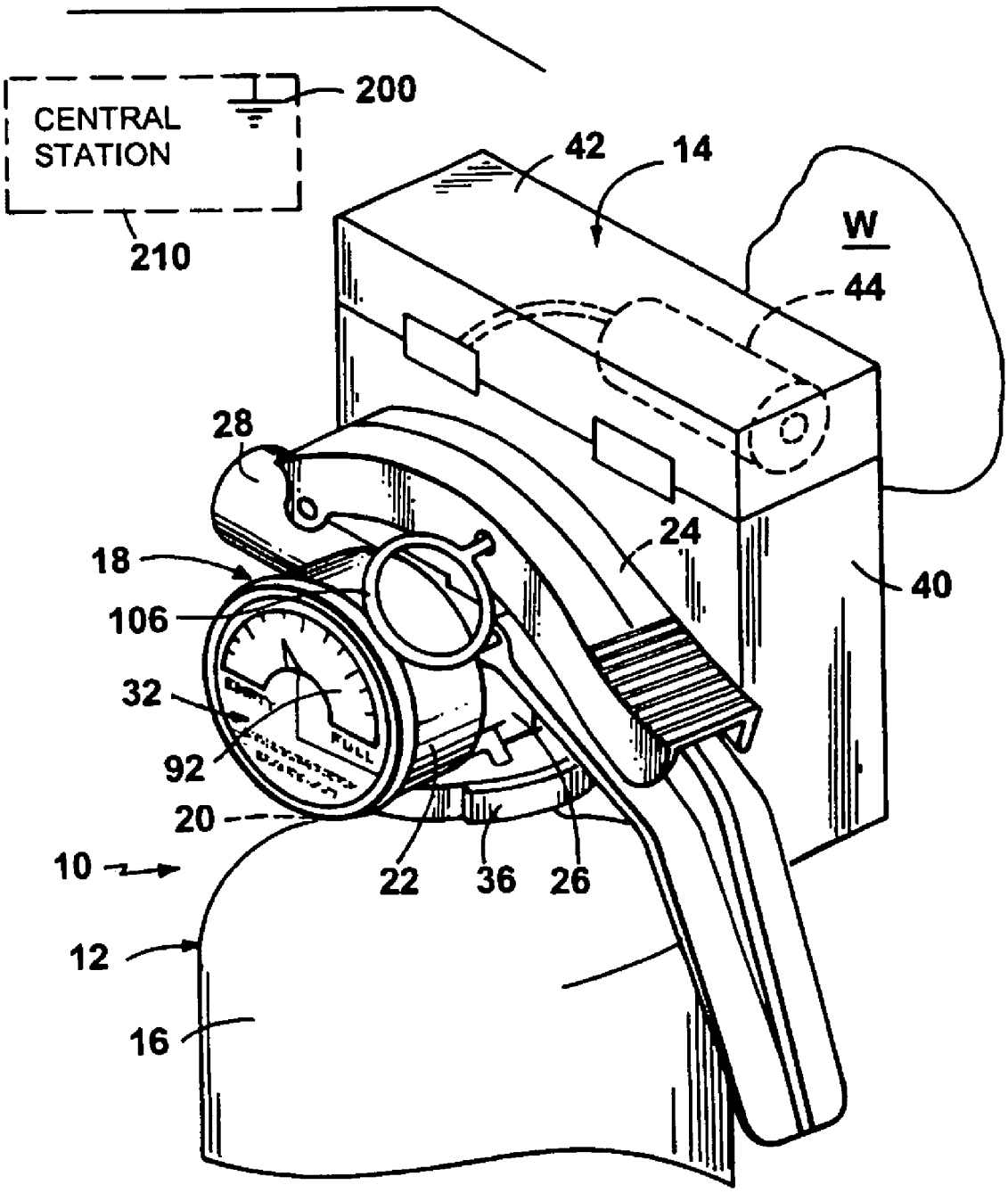
FIG. 1 is a perspective view of a signaling fire extinguisher assembly.
Figure 2:
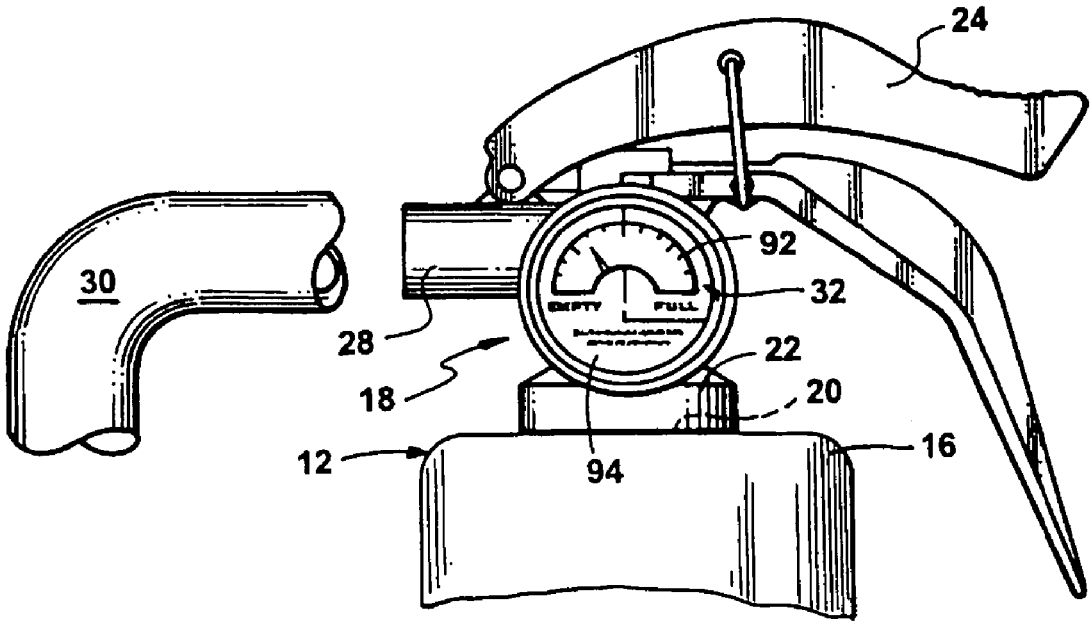
FIG. 2 is a front elevational view of the signaling fire extinguisher of the signaling fire extinguisher assembly of FIG. 1.
Figure 3:
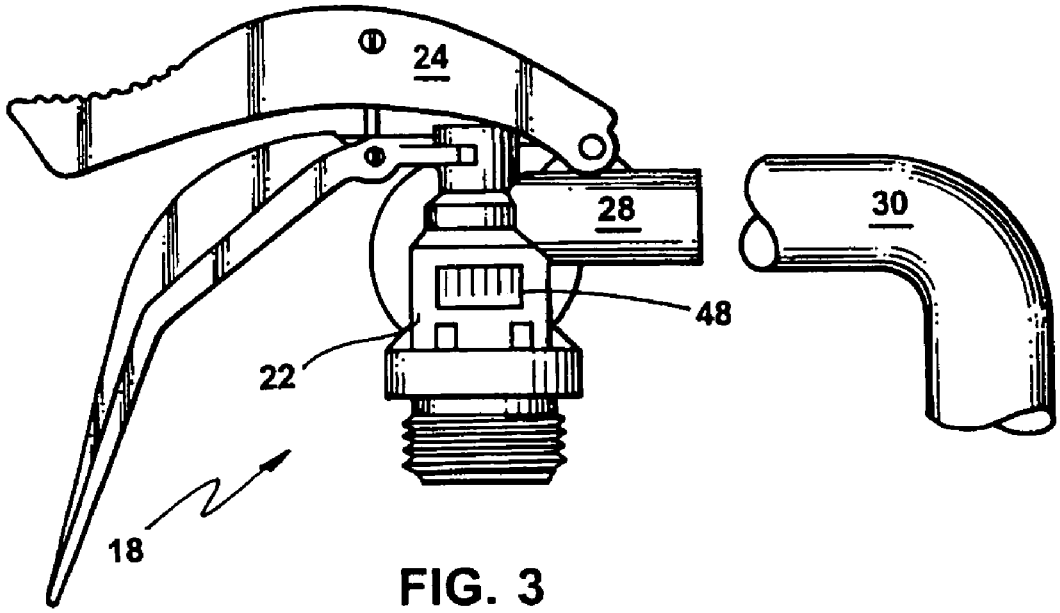
FIG. 3 is a rear elevational view of the fire extinguisher valve assembly of the signaling fire extinguisher of FIG. 2.
Figure 4:
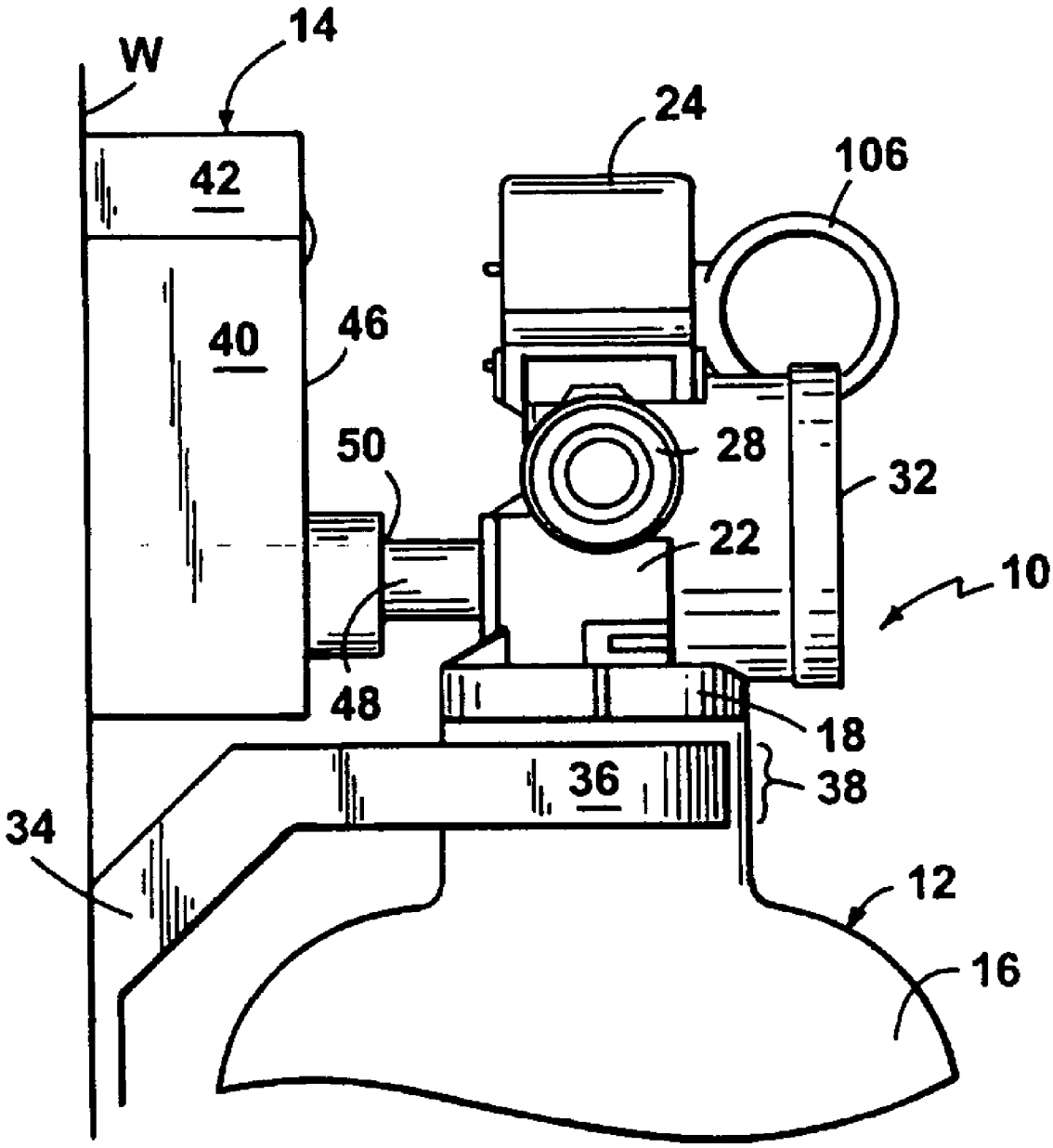
FIG. 4 is a side elevational view of the signaling fire extinguisher assembly of FIG. 1.
Figure 5:
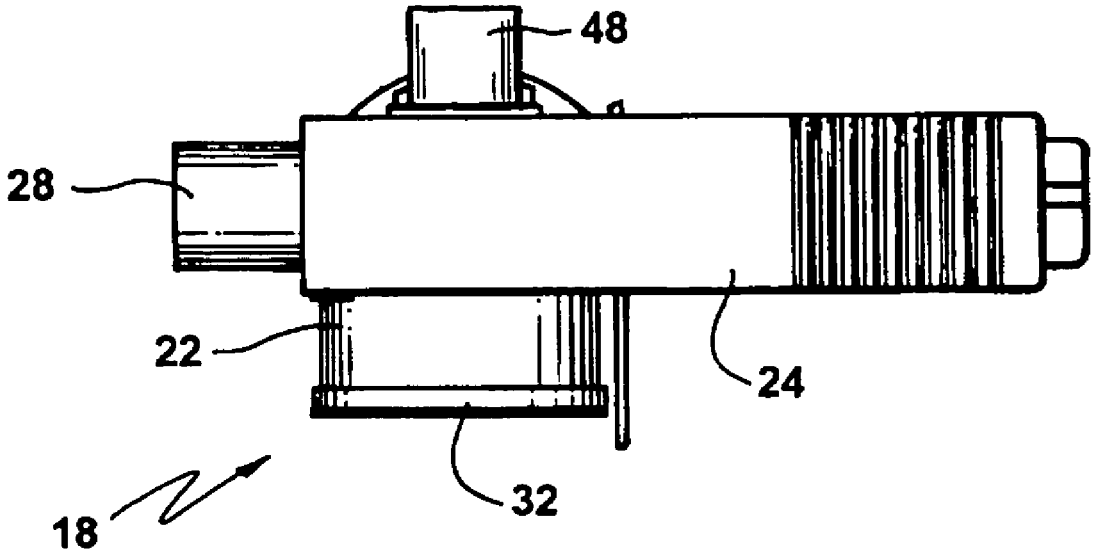
FIG. 5 is a top plan view of the fire extinguisher valve assembly of FIG. 3.

Referring to FIGS. 1-5, a portable fire extinguisher assembly 10 includes a fire extinguisher 12 and a fire extinguisher docking station 14.

The fire extinguisher 12 includes a fire extinguisher tank 16 containing a fire extinguishing material, e.g., water, dry chemical, or gas, and a fire extinguisher valve assembly 18 (e.g., as provided by MIJA Industries Inc., of Rockland, Mass.) mounted to releasably secure a tank opening 20. The valve assembly includes a body 22, e.g., an integral body formed of molded plastic, and a trigger mechanism 24 for opening a valve 26 for release of fire extinguishing material, typically through a nozzle 28 (and, optionally, hose 30, FIG. 2) provided to direct the released material in a desired direction, e.g., at the base of a flame. The valve assembly further includes a gauge 32 (e.g., a Bourdon coiled tubing gauge of a type also manufactured by MIJA Industries Inc.) to provide indication of the status of the fire extinguishing material within the fire extinguisher tank 16. Extending from the rear surface of the valve body 22 is a male hard pin electrical connector element 48 for electrical and communication connection between the fire extinguisher 12 and the docking station 14, as will be described below.

The fire extinguisher is removably mounted on a wall hanger or bracket 34 (FIG. 4), fixedly secured to a wall, W, or other surface. The bracket has a pair of opposed arms 36 that releasably engage about the neck region 38 of the fire extinguisher tank 16, generally below the valve body 22.

Fixedly mounted to the wall, W, at a predetermined position generally spaced above the bracket 34, is the docking station 14. The docking station consists of a housing 40 with a hinged cover 42. Disposed within the docking station housing are elements of electronic and communication circuitry, as described more fully below, and a power supply, e.g., a battery 44 (FIG. 1). The face surface 46 of the housing defines a female socket 50 for electrical and communication connection between the docking station 14 and the fire extinguisher 12, as will be described below.

The fire extinguisher 12 and docking station 14 are positioned for contact closure between the male connection element 48 and the female connection socket 50 by snap fit engagement of the neck region 38 of the fire extinguisher tank 16 within the opposed arms 36 of the mounting bracket 34.

Figure 9:
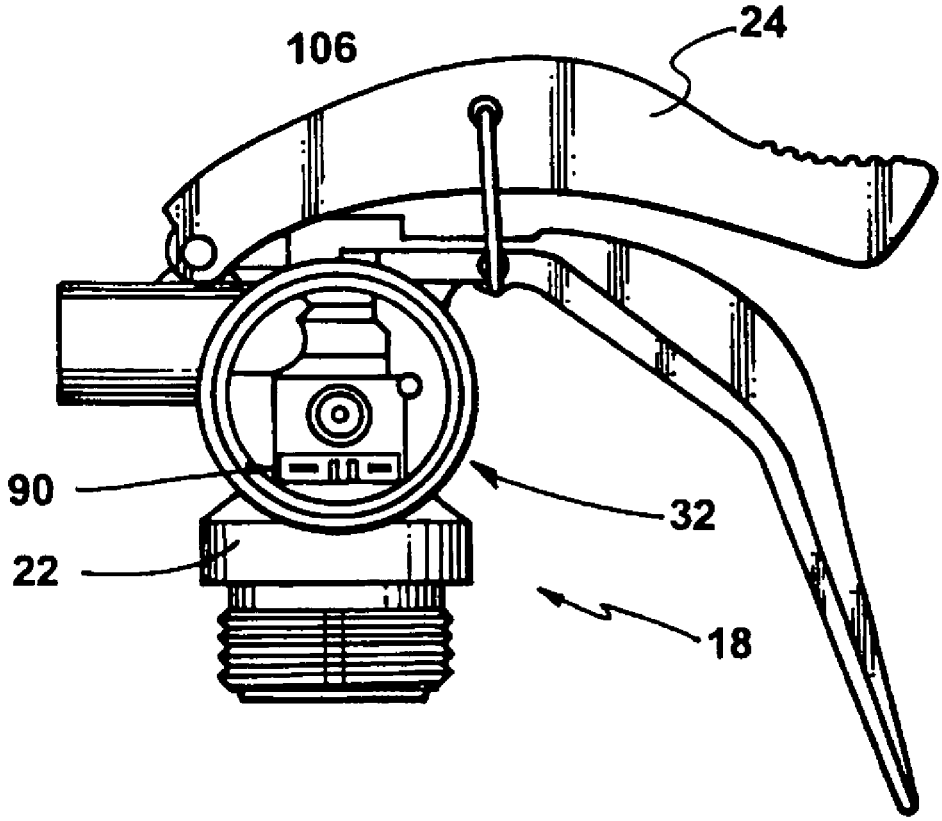
FIG. 9 is a front elevational view of another embodiment of a fire extinguisher valve assembly, similar to FIG. 2, the fire extinguisher valve assembly housing being shown with the gauge removed to reveal electronic circuit disposed therewithin.
Figure 6:
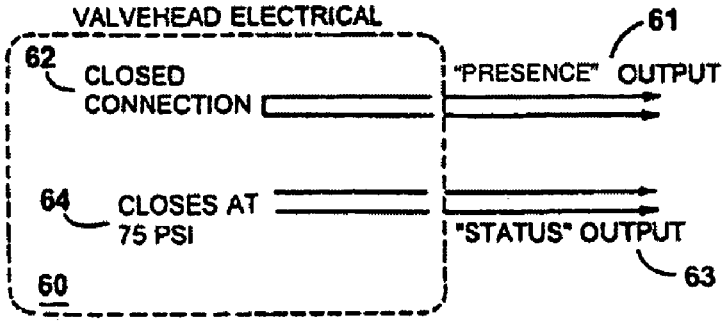
FIG. 6 is a block diagram of the fire extinguisher valve assembly electrical circuitry for one embodiment of a signaling fire extinguisher assembly.
Figure 7:
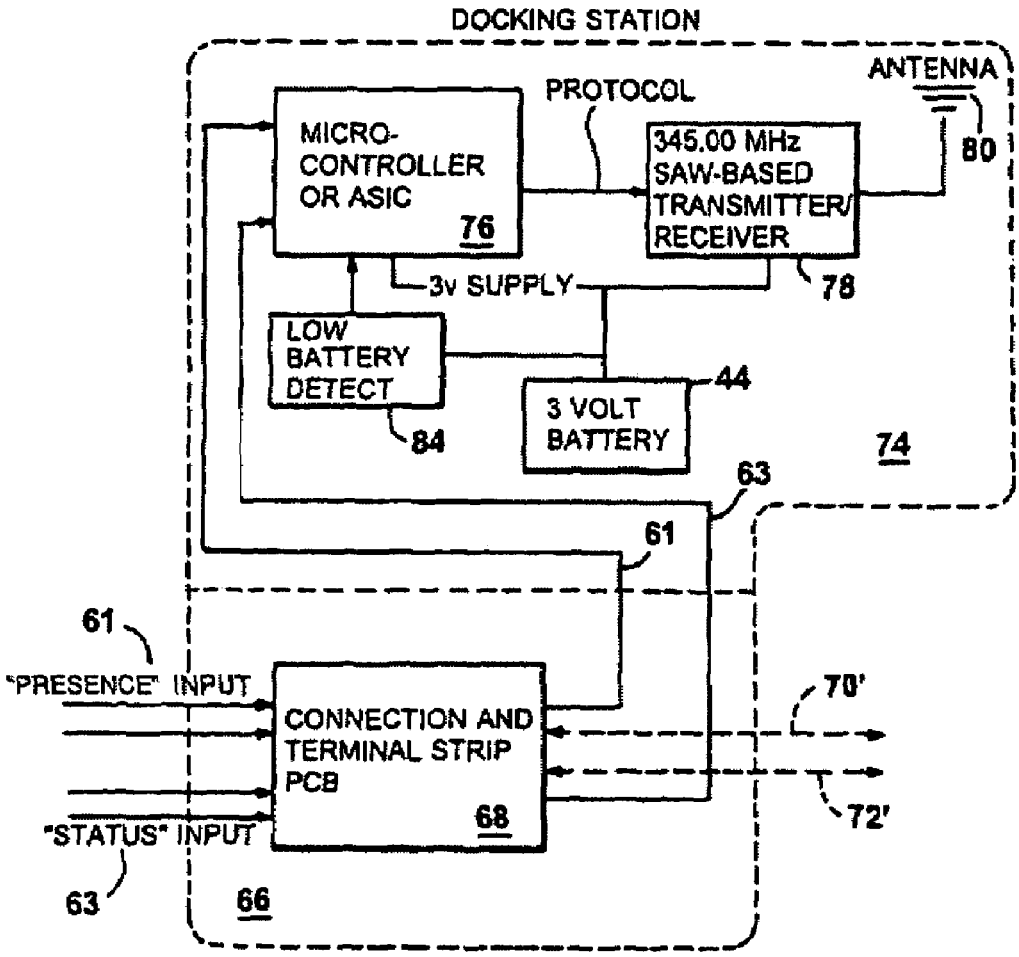
FIG. 7 is a block diagram of fire extinguisher docking station electrical circuitry for one embodiment of a signaling fire extinguisher assembly.

Referring now to FIGS. 6 and 7, the fire extinguisher valve assembly 18 contains electrical and communication circuitry 60 for issuing signals to the docking station 14. For example, in the preferred embodiment, the circuitry 60 issues a signal 61 for a predetermined external condition, e.g., non-presence of the fire extinguisher, when the fire extinguisher is removed from the bracket arms 36, thereby disengaging the male connector element 48 of the fire extinguisher 12 from the female socket 50 of the docking station 14, and disrupting the closed connection 62. The circuitry 60 also issues a signal 63 for a predetermined internal condition, e.g., existence of a low pressure condition in the fire extinguisher tank, for example, as described below with respect to FIG. 9, thereby opening the connection 64.

According to one embodiment (FIG. 7), the signals 61, 63 are communicated via the electrical/communication connection of the male connector element 48 of the fire extinguisher 12 with the female socket 50 of the docking station 14 to electrical/communication circuitry 66 within docking station 14. The signals indicating the presence of the fire extinguisher and that pressure in the fire extinguisher tank is above the predetermined minimum level are received by a connection and termination strip process control board ("PCB") 68 and communicated to RF (radio frequency) communication electrical circuitry 74 within the docking station 14. The signals are received by a microcontroller or ASIC 76 and transmitted via a 345.00 MHz SAW-based transmitter and receiver 78 and antennae 80 to a remote RF monitoring/signaling system receiver/transmitter (not shown), e.g., at a remote central station 210 (FIG. 1). The electrical circuitry 74 also includes the power supply, e.g., battery 44, for powering the microcontroller 76 and transmitter 78, and also a low battery detector 84.

Figure 8:
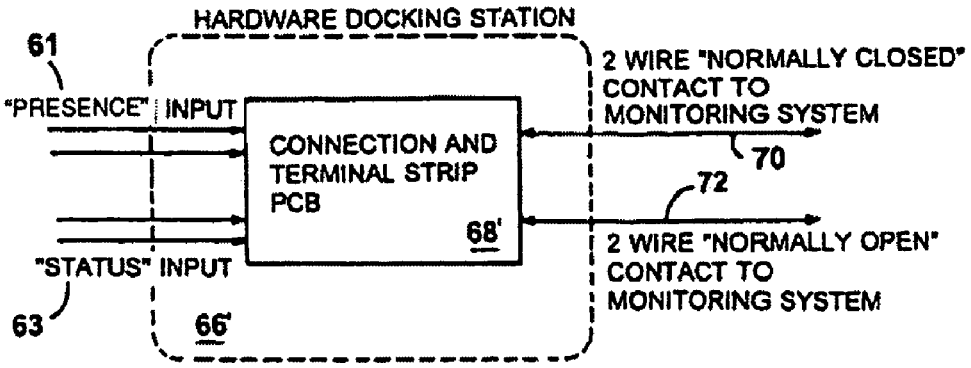
FIG. 8 is a block diagram of fire extinguisher docking station electrical circuitry for another embodiment of a signaling fire extinguisher assembly.

In another embodiment (FIG. 8), the signals 61, 63 received by a connection and termination strip process control board ("PCB") 68' of electrical/communication circuitry 66' are transmitted via hardwire connections 70, 72 to a remote central station 210 (FIG. 1). In this embodiment, connection 70 is a two-wire connection in normally closed state, signaling the presence of the fire extinguisher, and connection 72 is also a two wire connection, but in normally open state, signaling that pressure in the fire extinguisher tank is above the predetermined minimum level.

It is contemplated that, in other embodiments, signals 61, 63 may be communicated, e.g., simultaneously, via both hardwire (e.g., hardwire connections 70', 72' shown in dashed line in FIG. 7) and RF (or other) communication circuitry to a remote central or other monitoring station e.g., central station 210 (FIG. 1).

In operation of a fire extinguisher assembly 10 of the invention, the fire extinguisher 12 is releasably mounted to bracket 34 fixedly secured to wall, W (or other surface), the bracket having a pair of opposed arms 36 that releasably engage about the neck region 38 of the fire extinguisher tank 16, generally below the valve assembly body 22. As positioned by snap fit of the extinguisher into the arms of the bracket, the male connection element 48 at the rear of the valve assembly 18 of the fire extinguisher 12 is engaged in electrical and communication connection with the female socket 50 of the docking station housing 14.

The docking station 14 contains a circuit board programmed with the protocols for certain alarms or signals relating to predetermined internal and external conditions, and a battery 44 for power.

In the preferred embodiment, when the contents of the fire extinguisher tank 16 reach a predetermined low pressure point, the circuit 64 closes and signal 63 is issued, e.g., for communication to a central station. If the fire extinguisher 12 is removed, the circuit 62 is opened and signal 61 is issued and communicated to a central station. The central station may also send signals to the fire extinguisher assembly 10 to periodically check its status for internal and external conditions, e.g., low pressure and presence.

Other embodiments are within the following claims. For example, in some instances, an electronic circuit 88 is contained on a circuit board 90 (FIG. 9) mounted to the fire extinguisher valve assembly 18 beneath gauge 32 and powered, e.g., by battery 44 disposed within the docking station, or within a compartment (not shown) defined by the fire extinguisher valve body 22.

As in the embodiment shown, the circuit 88 may optionally further include an electroluminescent light panel 92 mounted upon the face 94 of the valve gauge 32. (The electroluminescent light panel 92 mounted to gauge face 94 is shown also in FIGS. 1 and 2).

Figure 10:
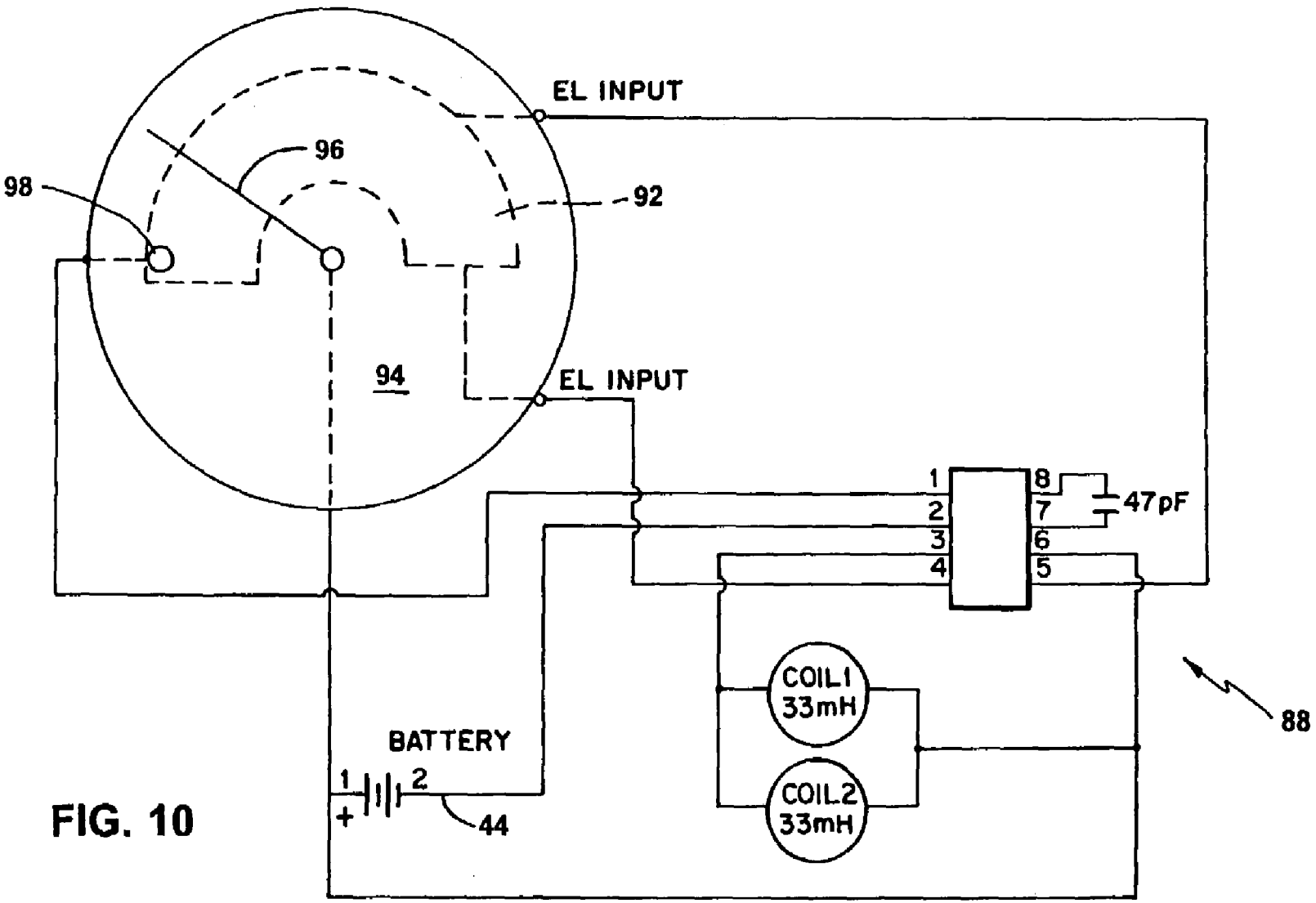
FIG. 10 is a circuit diagram of an electronic circuit for a signaling fire extinguisher assembly.

Referring also to FIG. 10, in some embodiments, the electronic circuit 88 includes the valve gauge pointer 96 and a contact 98 located in a region upon the gauge face 94 selected for interengagement of the contact and the gauge pointer, e.g., when the contents of the tank are at a low pressure condition. Interengagement of the gauge pointer and contact may optionally complete the circuit to illuminate the light panel 92, thereby to generate a visual signal to passersby, warning of the low pressure condition of the fire extinguisher.

Figure 11:
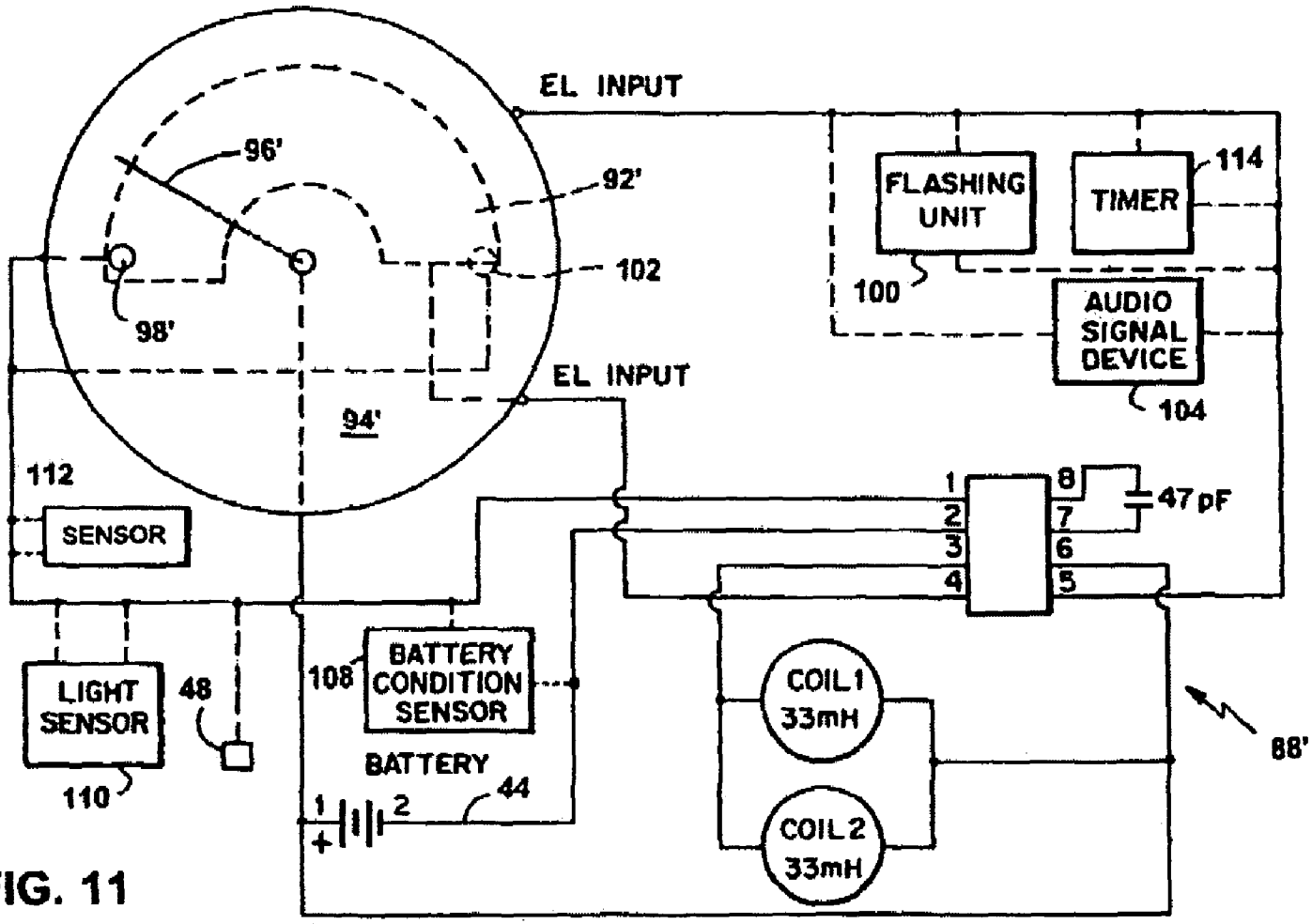
FIG. 11 is a similar circuit diagram of an electronic circuit for a signaling fire extinguisher assembly.

Also, referring to FIG. 11, in some embodiments, an electronic circuit 88' additionally includes a flashing unit 100 for intermittent illumination of the light panel, thereby to better attract the attention of passersby, and also to conserve battery life.

The electronic circuit 88' additionally or instead may, in some embodiments, include a contact 102 located in a region selected for interengagement of the contact 102 and the gauge pointer 96' when the contents of the fire extinguisher tank are at a high or overcharged pressure condition.

The electronic circuit 88' may also include an audio signaling device 104, e.g., as part of the docking station, for emitting, e.g., a beeping sound, instead of or in addition to the visual signal. The audio signal device may be triggered when the fire extinguisher is placed in use, e.g., upon removal of the pull pin 106 (FIG. 1) securing the trigger thereby to trip a sensor. The audio signal may consist of a recorded information message, e.g., instructions for use of the fire extinguisher including the type of fire for which use is appropriate, e.g., papers, electrical, liquid, all types.

The electronic circuit 88' may also include a battery condition sensor 108 to actuate a visual and/or audio signal, e.g., at the central station, when a low battery condition is detected.

The electronic circuit 88' may also include a light sensor 110, e.g., of ambient light conditions, to actuate illumination of the light panel 92' in low or no light conditions, e.g., to signal the location of the extinguisher at night or upon loss of power to external lighting.

The electronic circuit 88' may also include a sensor 112 adapted to sense other local conditions, e.g., smoke or fire, to actuate illumination of the light panel 92' and/or audio signal device 104 when smoke or other indications of a fire are sensed, e.g., to signal the location of the extinguisher when visibility is low.

The electronic circuit 88' may include a timer 114 set to actuate the visual and/or the audio signal after a predetermined period of time, e.g., the recommended period between inspections, unless the timer is reset.

The electronic circuit 88' may be responsive to a signal from an external source, e.g., a system of smoke detectors, a fire extinguisher or suppression system, or the like, to actuate the visual and/or the audio signal.

The electronic circuit 88' may also include an encoded identification specific to each fire extinguisher for receiving and dispatching signals or messages, e.g., of extinguisher condition or local status, via the electrical/communication connection with the docking station and/or the internal RF antenna, identifiable as relating to that extinguisher, to a central station and/or to other elements of a home or facility security system.

What is claimed is:

1. Apparatus for remote monitoring of a fire extinguisher, the apparatus comprising:

a pressure sensor configured to detect pressure of fire extinguishing material contained within a volume defined by a fire extinguisher tank;

communications circuitry in communication with the pressure sensor and configured to issue a signal containing information about the pressure detected by the pressure sensor to a remote central station;

a gauge mounted to the fire extinguisher and disposed in communication with the volume for detection and display of a pressure condition of the fire extinguishing material contained within the volume of the fire extinguisher tank; wherein the gauge comprises:

a gauge scale, and a gauge pointer moveable relative to said gauge scale for indication of pressure; and an electrical switch that is tripped when the gauge pointer moves to a predetermined location relative to the gauge scale indicating the pressure condition is at a predetermined pressure reading.

2. The apparatus of claim 1 wherein the fire extinguisher is a portable fire extinguisher.

3. The apparatus of claim 2 wherein the portable fire extinguisher is a hand-held portable fire extinguisher.

4. The apparatus of claim 1 wherein the communications circuitry is configured to issue a signal upon detection by the pressure sensor of a predetermined pressure condition.

5. The apparatus of claim 4 wherein the predetermined pressure condition comprises a predetermined pressure reading.

6. The apparatus of claim 1 wherein the communications circuitry is configured to periodically issue a signal containing information about the pressure detected by the pressure sensor to the remote central station.

7. The apparatus of claim 1 wherein the gauge comprises a Bourdon coiled tube gauge.

8. The apparatus of claim 1 further comprising a docking station.

9. The apparatus of claim 8 wherein docking station is configured to house at least part of the communications circuitry.

10. The apparatus of claim 2 wherein the portable fire extinguisher is configured to be installed in a predetermined location, the apparatus further comprises:

a second sensor configured to detect removal of the portable fire extinguisher from its predetermined location, and wherein the electronic circuit is further configured to issue a signal to the remote central station upon detection of removal of the portable fire extinguisher from its predetermined location.

11. The apparatus of claim 10 wherein the second sensor comprises a tether.

12. The apparatus of claim 1 further comprising an electroluminescent light panel configured to illuminate a portion of the fire extinguisher in a low light condition.

13. The apparatus of claim 1 further comprising an audio signaling device configured to emit an audible signal upon detection of an out-of-range pressure condition detected by the pressure sensor.

14. The apparatus of claim 1 further comprising a timer configured to trigger an alert when an inspection is due for the fire extinguisher.

15. The apparatus of claim 1 wherein the communications circuitry is powered with a battery.

16. The apparatus of claim 15 further comprising a battery monitor configured to trigger an alert when the battery reaches a predetermined low power level.

17. The apparatus of claim 1 further comprising a light sensor configured to detect a low light condition.

18. The apparatus of claim 1 further comprising circuitry for illuminating at least a part of a fire extinguisher when the light sensor detects a low light condition.

19. The apparatus of claim 1 wherein the communication circuitry is configured to receive signals from the remote central station.

20. The apparatus of claim 1 wherein the signal issued by the communications circuitry also includes identification information that identifies the fire extinguisher for which the signal was issued.

21. The apparatus of claim 1 wherein the signal comprises a wireless signal.

* * * * *

UNITED STATES PATENT AND TRADEMARK OFFICE

CERTIFICATE OF CORRECTION

PATENT NO. : 7,450,020 B2
APPLICATION NO. : 11/123899
DATED : November 11, 2008
INVENTOR(S) : Brendan T. McSheffrey and John McSheffrey, Sr.

It is certified that error appears in the above-identified patent and that said Letters Patent is hereby corrected as shown below:

On the title page, column 2, line 1, item [57] Abstract, delete "Apparatus" and insert --An apparatus--, therefor.

In Claim 1, column 5, line 66, delete "Apparatus" and insert --An apparatus--, therefor.

In Claim 9, column 6, line 39 (approx.), after "wherein" insert --the--.

Signed and Sealed this

Sixth Day of July, 2010

David J. Kappos

David J. Kappos
*Director of the United States Patent and Trademark Office*